US008302447B2

(12) United States Patent
Schmitz et al.

(10) Patent No.: US 8,302,447 B2
(45) Date of Patent: Nov. 6, 2012

(54) DEVICE FOR FORGING BUSH-SHAPED OBJECTS AND A FORGED PART PRODUCED THEREWITH

(75) Inventors: Ernst-Peter Schmitz, Abtsgmuend (DE); Peter Kolbe, Aalen (DE)

(73) Assignee: Gesenkschmiede Schneider GmbH, Aalen (DE)

( * ) Notice: Subject to any disclaimer, the term of this patent is extended or adjusted under 35 U.S.C. 154(b) by 633 days.

(21) Appl. No.: 12/299,549

(22) PCT Filed: Apr. 24, 2007

(86) PCT No.: PCT/DE2007/000730

§ 371 (c)(1), (2), (4) Date: Jan. 28, 2009

(87) PCT Pub. No.: WO2007/128264

PCT Pub. Date: Nov. 15, 2007

(65) Prior Publication Data

US 2009/0301165 A1 Dec. 10, 2009

(30) Foreign Application Priority Data

May 4, 2006 (DE) ..... 10 2006 020 861

(51) Int. Cl.
*B21K 1/42* (2006.01)
*B21D 53/26* (2006.01)

(52) U.S. Cl. ..... 72/354.2; 72/344; 72/355.6; 72/356; 29/892

(58) Field of Classification Search ..... 72/325, 72/355.2, 355.6, 356, 344; 29/892
See application file for complete search history.

(56) References Cited

U.S. PATENT DOCUMENTS 4,423,617 A * 1/1984 Nippert ..... 72/356
4,621,514 A 11/1986 Dohmann et al.
4,682,487 A * 7/1987 Kaeseler ..... 72/355.2
4,779,444 A * 10/1988 Hite et al. ..... 72/355.6

(Continued)

FOREIGN PATENT DOCUMENTS

DE 41 09 628 A1 1/1992

(Continued)

OTHER PUBLICATIONS

International Search Report for International Application No. PCT/DE2007/000730.

*Primary Examiner* — David B Jones
(74) *Attorney, Agent, or Firm* — Roberts Mlotkowski Safran & Cole, P.C.; David S. Safran

(57) ABSTRACT

A device and method are provided for forging sleeve-shaped parts such as pistons. The device includes a form with: an upper form mandrel (C); an outer form ring (A); a lower form mandrel (B); an ejector device with an upper ejector (G) for ejection through the upper form mandrel (C); a lower ejector (H) for ejection through the lower form mandrel (B). Optional support devices for the form include a lower reinforcement ring (D) for the lower region of the outer form ring (A), a form mandrel housing (F) for the upper region of the outer form ring (A), and a clamping base (E) to support the lower form mandrel (B), by means of which the lower ejector (H) may be operated. The device and method advantageously facilitates the manufacture of pistons having a long skirt length and a minimal wall thickness.

10 Claims, 5 Drawing Sheets

U.S. PATENT DOCUMENTS

| | | | | |
|---|---|---|---|---|
| 4,847,968 | A * | 7/1989 | Shirai et al. | 29/892 |
| 4,914,938 | A * | 4/1990 | Ishinaga | 72/355.2 |
| 4,916,931 | A * | 4/1990 | Kaeseler | 72/355.6 |
| 4,918,970 | A * | 4/1990 | Ishinaga | 72/355.6 |
| 5,218,853 | A * | 6/1993 | Mueller et al. | 72/325 |
| 6,250,128 | B1 * | 6/2001 | Ando et al. | 72/355.6 |
| 6,357,274 | B1 * | 3/2002 | Tanaka et al. | 72/356 |
| 6,507,999 | B1 | 1/2003 | Kaibyshev et al. | |
| 7,013,696 | B2 * | 3/2006 | Ando et al. | 72/355.6 |
| 7,043,955 | B2 | 5/2006 | Nagao et al. | |
| 7,059,165 | B2 * | 6/2006 | Siegert et al. | 72/355.6 |
| 7,191,633 | B1 | 3/2007 | Uehara et al. | |
| 7,213,337 | B1 | 5/2007 | Pôrto et al. | |
| 2004/0177503 | A1 | 9/2004 | Bing et al. | |

FOREIGN PATENT DOCUMENTS

| | | | |
|---|---|---|---|
| DE | 102 30 837 | B4 | 12/2004 |
| EP | 0 220 031 | A2 | 4/1987 |
| GB | 1 441 762 | A | 7/1976 |
| JP | 4-41036 | A | 2/1992 |
| JP | 2000-263178 | A | 9/2000 |

* cited by examiner

DEVICE FOR FORGING BUSH-SHAPED OBJECTS AND A FORGED PART PRODUCED THEREWITH

BACKGROUND OF THE INVENTION

1. Field of Invention

The invention relates to a device for the forging of sleeve-shaped objects like steel pistons, a method for the production of sleeve-shaped forgings and forgings produced according to the method.

2. Description of Related Art

Sleeve-shaped forgings are often produced from forgings of iron alloys, primarily steels. Such forgings are at least partially hot forged. A very common application of this type of sleeve-shaped parts is that of pistons for combustion engines. Although the invention is explained the context of the production engine pistons, these types of sleeves are also used in many other applications so that the present invention is generally applicable to all sleeve-shaped components made of forgeable material.

In the prior art, pistons for combustion engines are forged in two steps, wherein a blank piston is inserted into a die having a pre-cavity to produce a semi-finished element in a first step. The semi-finished element is then definitively forged by another cavity into a final forging in a second step. The device for implementing this two step method includes a lower form mandrel that is surrounded by an external form ring or forging sleeve.

Because pistons require a high level of mechanical forming to fill the cavity parts, piston blanks are often worked with flash cushions. In this way, the long flow distance of the material to be forged is regularly distributed over the forming steps.

The prior art method having essentially two forging steps is accompanied by temperature changes (cooling) which result in increased resistance against deformation. Such deformation resistance sets narrow boundaries to the achievable piston skirt thickness and to the piston skirt length. However, today, because of many reasons, it is desirable to achieve minimal piston wall thickness levels by having the biggest piston skirt length possible. Such a piston shape results in a low weight, an improved thermal expansion capacity, and a long control inside the cylinder sleeve. This desired thin wall can be achieved together with a long piston skirt only by having a very deep cavity and is achievable only by additional working beyond the two forging steps.

A method of this type is energy-consuming because at least two forging stations must be provided. Additionally, measures had to be taken in order to avoid excessive cooling of the forged parts between the stations which required additional handling costs.

For these reasons, a more rapid and easier forging method for sleeve-shaped objects is needed, as well as suitable equipment to implement such a method.

A further problem relating to the forging of sleeve-shaped parts in forging devices having cavity is the lifetime of the tools. Deep cavities, long flow distances, high pressure inside the tools, and rapid cooling by application of lubricants, all limit the life time of the lower form mandrel and the external form ring, or forging sleeve. A replacement or a rework of the tool and its parts causes downtime during the production process which makes the execution of the method more costly. Tools are expensive and must be put available for production with minimum downtime caused by the need to repair or replace them.

As a consequence, the problem the present invention seeks to solve consists of avoiding the disadvantages of prior art forging methods for sleeve-shaped forging elements.

SUMMARY OF THE INVENTION

These disadvantages of the prior art are avoided by the device of the present invention which has a long service life and achieves sleeve-shaped forged parts having thin walls, and a long piston skirt.

The device for the forging of sleeve-shaped parts according to the present invention comprises:

- a form equipped with a superior form mandrel, an external form ring and an lower form mandrel;
- a pushing device equipped with an upper ejector for ejecting through the upper form mandrel and the lower ejector for ejecting through the lower form mandrel;
- optional support devices for the form having an lower reinforcement iron ring for the lower area of the external form ring and of a form mandrel housing for the upper part of the external form ring; and
- a clamping base that supports the lower form mandrel through which a lower ejector can be activated.

Temperature control is essential when having to form hot parts. It is important that the temperature of the hot formed part is quickly and if possible regularly conducted inside the tool so that cold work hardening of the new form takes place and distortion of the component by uncontrolled temperature changes during the cooling process outside the form is avoided. According to the present invention, the internal form mandrel is provided with a high mass and is disposed inside the tool so that it has a tendency to cool more slowly than the other tool components.

Temperature control may also be achieved by providing cooling channels for cooling fluid including liquids or gasses, the shape and size of the channels being determined by the proportions of the form used and the heat capacity of its materials. It is also possible to control temperature by choosing another material of the form mandrel that has a different thermal conductivity. A further possibility consists of cooling the form mandrel (which because of its high thermal conductivity diverts heat very quickly) by cooling the clamping base and/or the lower ejector indirectly by heat dissipation. Cooling equipment of this kind can also be provided in other parts of the form.

A special feature of the present invention results from the interaction between the lifting and the extraction unit. Specifically, because a negative extraction cone alpha angle is provided inside the cavity of the upper form mandrel, the forged part is reliably lifted from the tool. The back-sliding of the forging blank into the forging form is hindered by the lower ejector which can be activated by the clamping base. By interaction between the upper and lower ejector, deep ejection marks and shape distortions can be avoided by a unilaterally acting force.

The method of the invention for the forging of sleeve-shaped forged parts includes:

- the provision of a preform;
- closure of the form comprising the upper and lower form mandrel and the form ring in one forging hub while forming the preform;
- opening of the form and the activation of at least one ejector, and
- ejection of the forged part.

Primarily in case of higher-dimensioned forged parts for better heat management it is preferred that the lower form mandrel and the forged part laying on it is cooled after the forming and before opening it.

In a preferred embodiment of the method of the present invention, the upper ejector is only activated after having achieved the upper dead point of the forming press, whereby a secure taking out of the finished part is possible.

By the constant material flow having a constant velocity, enabled according to the present invention, a form filled to its smallest radius is produced, and as a consequence a forged part coming up to requested dimensions is produced. In this way, forging mistakes and many reworks can be avoided.

Before the placement of the preform it is preferred that at least one internal wall of the form is coated with a lubricant or releasing agent by which the material flow is facilitated and the ejection of the forged part facilitated.

Finally, the invention includes a sleeve-shaped forged part, e.g. from 42CRMo4, dispersion hardening steels, chromium steels with high chromium content, which is primarily suitable for engine pistons for combustion engines, has a skirt length between 60 mm and 160 mm and a wall thickness between 6 mm and 12 mm.

Because the tool has a deep forging cavity with a minimal forging die chamfer and a cooled internal area and amoring, surprisingly the need of a second forging step for sleeve-shaped parts with a proportion of length to the external diameter of 0.5 m:1, is obviated, which reduces very much production time and costs.

The aspects mentioned above and further ones according to the present invention will become known to the person skilled in the art with the aid of the enclosed figures and of the detailed description of embodiments explained hereinafter, which the invention in no way restricts itself to.

DETAILED DESCRIPTION OF THE INVENTION

Figure 1A:
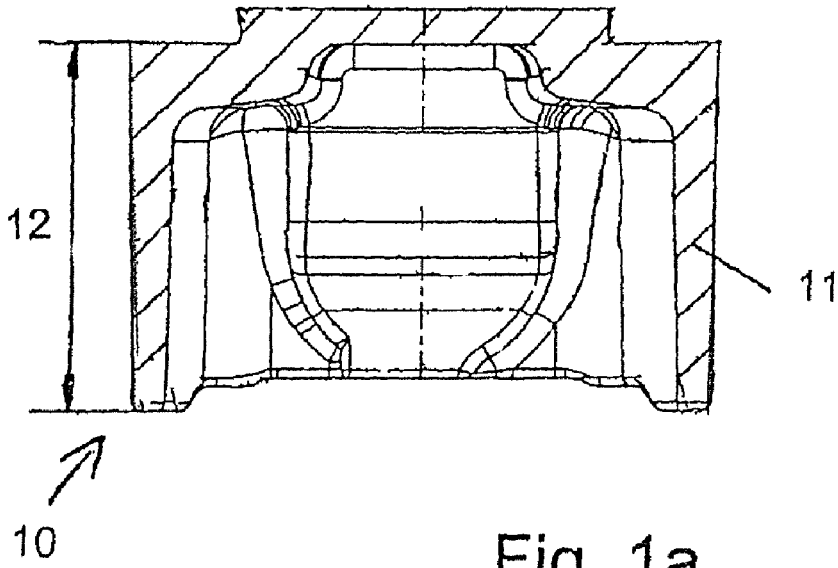
FIG. 1*a* is a view of a longitudinal section by means of an embodiment of a sleeve-shaped forged part produced by means of the forming tool of FIG. 2.
Figure 1B:
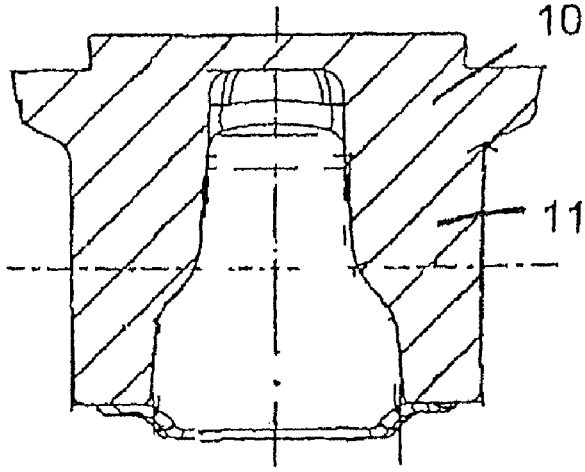
FIG. 1*b* is a 90° shifted view of a longitudinal section through an embodiment of a sleeve-shaped forged part according to FIG. 1*a* produced by the forming tool of FIG. 2.

In FIG. 1 there is a sleeve-shaped forged part, in this case a piston 10 for a combustion engine, produced according to the present invention. This type of piston for combustion engines is made of 42CrMo4 steel and has for instance the following dimensions: the piston skirt 14 is at least 0.5 longer than the external diameter of the piston, of approximately 135 mm. The thickness of the lateral wall of the piston 11 is of approximately ⅙ of the external diameter of the piston. If it is a typical engine piston for combustion engines made of 42CrMo4, the piston skirt length is 60 to 85 mm, the thickness of the lateral wall of the piston between 6 and 10 mm, and the external diameter of the piston is between 115 and 140 mm. In further embodiments, e.g. a piston 10 for ship engines or drive motors for energy production plants according to the material, there are also other common dimensions, as it is known to the person skilled in the art of every branch. In this context, the special wall thicknesses strongly depend on the material used and from the use of the piston.

Figure 2:
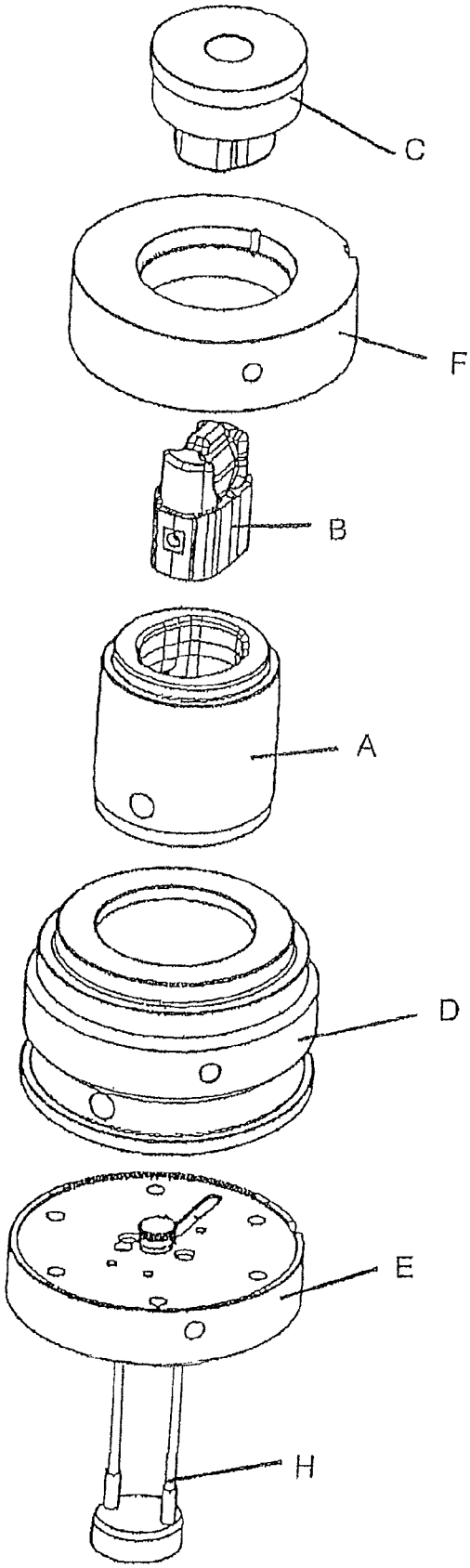
FIG. 2 is an exploded view of a forming tool according to the embodiment of the present invention.
Figure 4:
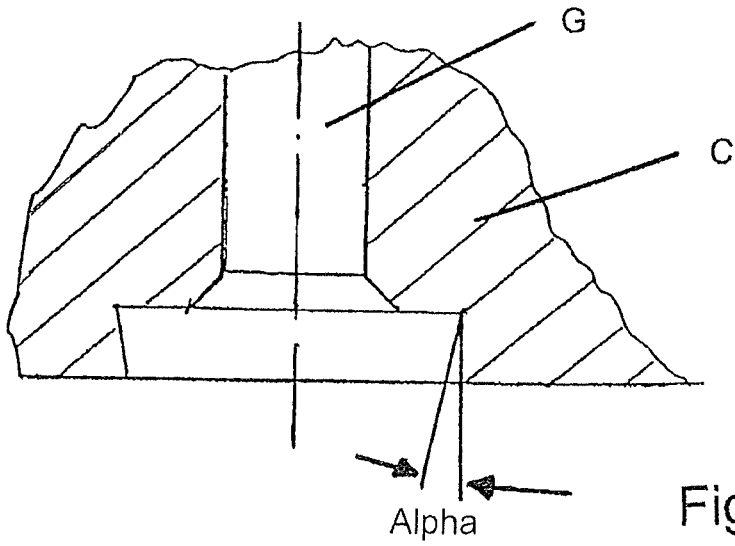
FIG. 4 shows a detailed view of a cross section of the upper form mandrel of the forming tool of FIG. 2.
Figure 3:
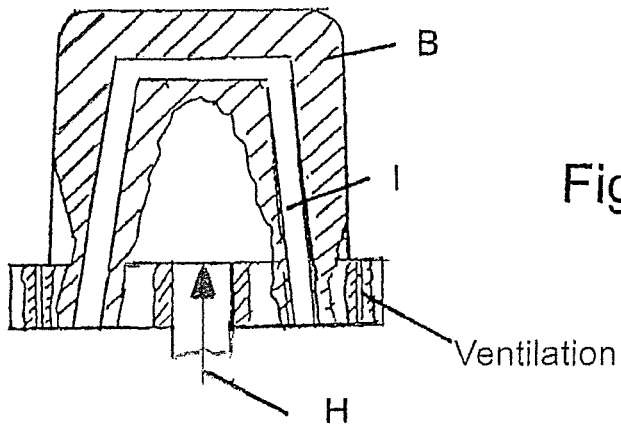
FIG. 3 is a detailed view of a cross sectioned the form mandrel of the forming tool of FIG. 2
Figure 5:
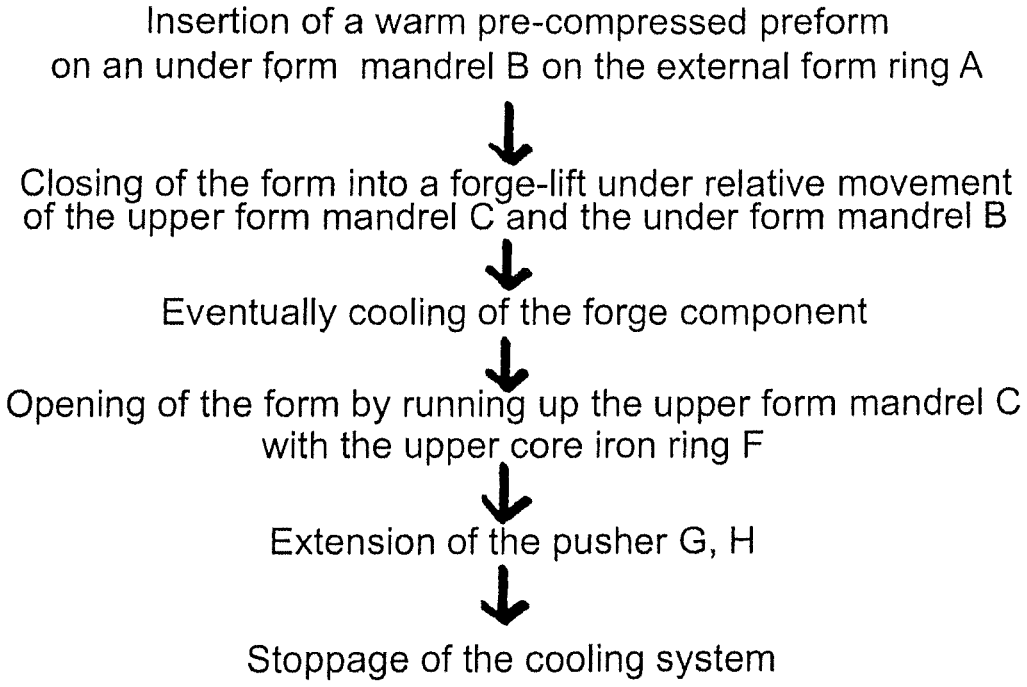
FIG. 5 is a flow chart of the forging method according to the present invention.
Figure 6:
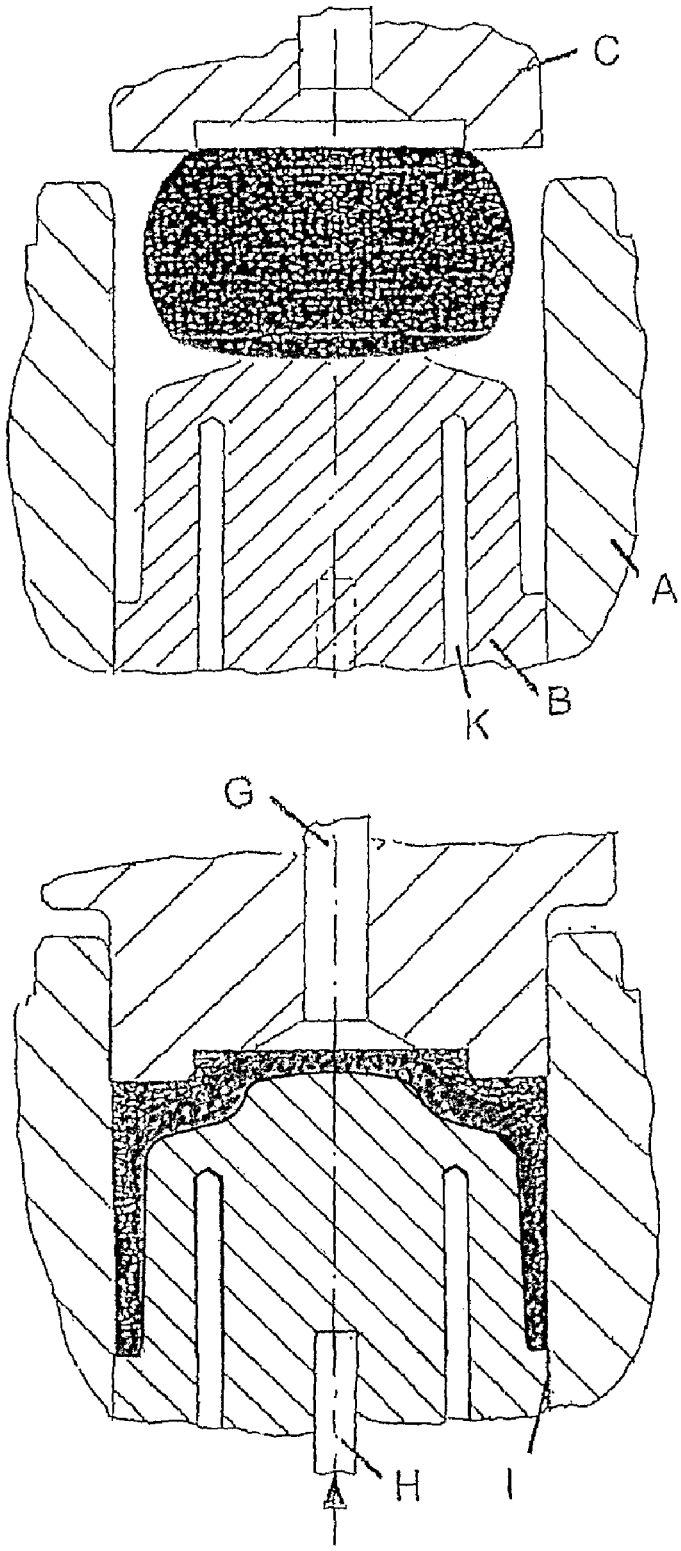
FIG. 6 illustrates two steps in the forming of the preform to the piston by means of a form tool according to the present invention.

A method suitable for the production of this type of piston 10 according to the present invention is carried out in the form tool of FIG. 2, as schematically shown in FIG. 6 by a longitudinal section with a form part inside it. The tool is equipped with an upper form mandrel C, whose special embodiment facilitates very much the forming of a preform in one step. In FIG. 4, a cross section through the upper form mandrel C is shown. Through the upper form mandrel the upper pusher G can be pushed down, which can remove a formed part from inside the engraving. In this context, also a negative forging die angle alpha in the cavity of the upper form mandrel C leading to the expulsion by the ejector G after the end of the lifting procedure, (the angle alpha being the so-called extraction angle).

The lower tool of the forging form which together with the upper form mandrel forms the engraving for the forging of the sleeve-shaped part, is formed by the lower form mandrel B and the external form ring A, between which the sleeve wall is formed according to the desired length and thickness.

The lower form mandrel B is designed so that it can be round but also formed by the lower ejector H which can be activated by means of the clamping base E, and so that it can be moved in relation to the external form ring A by facilitating in this way the expulsion of the forged part from the lower part tool, while avoiding the forging preform to backslide. The combination between the upper and lower ejector H, G reduces ejection marks in the form part and the distortion of the forged part by a good force distribution during the ejection process.

In a preferred embodiment, around the external form ring A there is an armor ring D which laterally supports the lower forming tool. This armor ring can also be made of another type of material than that of the form tools themselves, because it does not have to comply with the requirements relating to the features of the tools like low abrasion level, etc. In this way, an economically priced material can be used so that in case of the replacement of the tool only the external form ring A and the two form mandrels C and B must be replaced, which substantially facilitates the tool maintenance in a forging plant.

The ring-shaped form mandrel housing F supports the circumference of the upper form mandrel C and forms the upper part of the form together with it.

The ending part of the forging tool is the clamping base E which supports the lower form mandrel and permits a movement of the lower part form mandrel B by means of the ejector H inside it.

A method according to the present invention for forging a sleeve-shaped forged part is carried out as follows: A pre-forged preform is supplied by an automation device at a forming temperature and is put into the open forging form between the retracted upper form mandrel C and the lower form mandrel B in the external form ring A. This is possible when both the ejectors are retracted. After that the form is closed into a forging hub by which the two form mandrels are moved one towards the other and the preform is pressed against the form engraving walls by being formed. It is understood that the common form can by cyclically covered with form separation agents beforehand, wherein the types are common in the branch we refer to and known to the person skilled in the art. Gas pressures inside the form can by drained off by common aeration measures like aeration bore-holes I, by which also the lubricants and their remaining can be removed. The location of the aeration bore-holes is not limited to the lower form mandrel and can be varied according to the requirements obvious to a person skilled in the art.

By means of the flexible lifting and extraction unities it is possible to precisely lift the forged part from the tool, wherein this can be substantially promoted by a negative extraction cone angle alpha in the cavity of the upper form mandrel C, i.e, the cavity is provided with a frusto-conical shape that tapers from a bottom of the cavity to an open end as shown in FIG. 4.

In case a form mandrel cooling device is provided, it must be introduced before pushing the formed part in order to maintain the formed geometry.

Even though the invention was described with the aid of advantageous embodiment examples, it is apparent to the person skilled in the art that various alternative embodiments exist so that the scope of protection of the invention is defined through the claims.

What is claimed is:

1. Device for forging sleeve-shaped parts from a pre-forged preform to a finished forged part by means of a single forging step, comprising:

an upper form mandrel, having a cavity with a frusto-conical shape that tapers from a bottom of the cavity to an open end, an external form ring, a lower form mandrel, an ejecting device including a lower ejector for the ejection through the lower form mandrel, and an upper ejector for the ejection through the upper form mandrel, and a clamping base that supports the lower form mandrel, and is adapted for actuating the lower ejector, wherein, during the forging process, the upper and lower form mandrels are adapted to enter the form ring with the preform inside to forge the preform and wherein the upper and lower form mandrels are adapted to activate the upper and lower ejectors to eject the forged part, and wherein the lower form mandrel includes cooling medium channels.

2. Device according to claim 1, further comprising a support having a lower armoring ring for a lower part of the external form ring.

3. Device according to claim 1, further comprising a support having a form mandrel housing that surrounds and supports a circumference of the external form mandrel.

4. A one-step forging method for forging sleeve-shaped forged parts, comprising the steps of placing of a preform into a single form cavity formed by a form mandrel with a cavity having a frusto-conical shape that tapers from a bottom of the cavity to an open end, an external form ring and a lower form mandrel, closing the form;

forming the preform inside the form by extending form mandrels into the form ring against the preform to form it by forging;

opening the form and activating at least one ejector by one of the form mandrels, and ejecting the forged part, and including cooling the lower form mandrel by means of cooling channels.

5. Method according to claim 4, wherein the external form ring is laterally supported by an armoring ring.

6. Method according to claim 4, wherein a form mandrel housing surrounds and supports a circumference of the upper form mandrel.

7. Method according to claim 4, wherein the preform is produced by compression.

8. Method according to claim 4, wherein an upper ejector in the upper form mandrel is activated after an upper dead center of a forming press has been reached.

9. Method according to claim 4, wherein a forged part is produced having a skirt length between about 40 mm and 160 mm, and a wall thickness between about 4 mm and 12 mm.

10. Method according to claim 9, wherein the perform is produced from one or more materials from the group consisting of 42CrMo4, dispersion hardening steels and steels containing a high percentage of chrome.

* * * * *